US012508639B2

(12) United States Patent
Zhu et al.

(10) Patent No.: US 12,508,639 B2
(45) Date of Patent: Dec. 30, 2025

(54) MULTI-WATER-CHANNEL HOT STAMPING DIE

(71) Applicants: HUNAN SUNRISE AUTOMOBILE MOULD & DIE CO., LTD, Hunan (CN); HUNAN SUNRISE INTELLIGENT FORMING MANUFACTURING CO., LTD, Hunan (CN); Voestalpine Metal Forming GmbH, Krems an der Donau (AT)

(72) Inventors: Xin Zhu, Hunan (CN); Xiaoyong Zhu, Hunan (CN); Zihao Li, Hunan (CN); Junhong Du, Hunan (CN); Hongliang Dai, Hunan (CN)

(73) Assignees: Hunan Sunrise Automobile Mould & Die Co., Ltd, Hunan (CN); Hunan Sunrise Intelligent Forming Manufacturing Co., Ltd., Hunan (CN); voestalpine Metal Forming GmbH, Krems an der Donau (AT)

( * ) Notice: Subject to any disclaimer, the term of this patent is extended or adjusted under 35 U.S.C. 154(b) by 307 days.

(21) Appl. No.: 18/036,504

(22) PCT Filed: Nov. 15, 2021

(86) PCT No.: PCT/CN2021/130498
§ 371 (c)(1),
(2) Date: May 11, 2023

(87) PCT Pub. No.: WO2022/100721
PCT Pub. Date: May 19, 2022

(65) Prior Publication Data

US 2023/0398594 A1 Dec. 14, 2023

(30) Foreign Application Priority Data

Nov. 13, 2020 (CN) ..... 202011268005.4

(51) Int. Cl.
*B21D 37/16* (2006.01)
*B21D 22/02* (2006.01)
*B21D 37/10* (2006.01)

(52) U.S. Cl.
CPC ..... *B21D 37/16* (2013.01); *B21D 22/022* (2013.01); *B21D 37/10* (2013.01)

(58) Field of Classification Search
CPC ..... B21D 22/022; B21D 37/10; B21D 37/16; C21D 1/673
See application file for complete search history.

(56) References Cited

U.S. PATENT DOCUMENTS 10,195,656 B2 * 2/2019 Fukuchi ..... B21D 22/022
2009/0293571 A1 * 12/2009 Vehof ..... B21D 22/02 72/342.3

FOREIGN PATENT DOCUMENTS

CN 204135205 U 2/2015
CN 204747287 U 11/2015
(Continued)

OTHER PUBLICATIONS

CN 104275415A, Yao et al. Jan. 2015.*
(Continued)

*Primary Examiner* — Edward T Tolan
(74) *Attorney, Agent, or Firm* — Maxwell J. Petersen; FisherBroyles, LLP

(57) ABSTRACT

A multi-water-channel hot stamping die includes an upper die base and insert, a lower die base insert. The upper and lower die bases are provided with a water channel, which is provided with die cavities, in which water through openings are arranged and in communication. A caliber of water through openings is smaller than die cavities, introducing turbulence into the cooling medium in the water channels and the die cavities thus improving cooling efficiency. Die cavities are arranged in the main water channel in a non-
(Continued)

single straight line, water retaining blocks are placed at water through openings of the die cavities. A plurality of cooling zones is formed A plurality of inserts is correspondingly arranged in cooling zones, so that the of inserts are cooled simultaneously. Targeted control over cooling water flow of the main water channel is effected by supplying certain inserts with water.

20 Claims, 4 Drawing Sheets

(56) References Cited

FOREIGN PATENT DOCUMENTS

| | | | |
|---|---|---|---|
| CN | 105537423 | A | 5/2016 |
| CN | 111438247 | A | 7/2020 |
| CN | 211413392 | U | 9/2020 |
| CN | 112338065 | A | 2/2021 |
| KR | 20180125222 | A | 11/2018 |

OTHER PUBLICATIONS

CN 111570626A, Bi et al. Aug. 2020.*
CN 109622769A, Li et al. Apr. 2019.*
CN 110976665A, Jin et al. Apr. 2020.*
Espacenet Bibliographic data and Machine Translation for CN112338065A published Feb. 9, 2021 12 pages.
Espacenet Bibliographic data and Machine Translation for CN204747287U published Nov. 11, 2015 12 pages.
Espacenet Bibliographic data and Machine Translation for CN211413392U published Sep. 4, 2020 9 pages.
Espacenet Bibliographic data and Machine Translation for CN105537423A published May 4, 2016 13 pages.
Espacenet Bibliographic data and Machine Translation for CN111438247A published Jul. 24, 2020 15 pages.
Espacenet Bibliographic data and Machine Translation for CN204135205U published Feb. 4, 2015 9 pages.
Espacenet Bibliographic data and Machine Translation for KR20180125222A published Nov. 23, 2018 23 pages.
International Search Report for PCT/CN2021I130498, dated Jan. 27, 2022 3 pages.

* cited by examiner

MULTI-WATER-CHANNEL HOT STAMPING DIE

CROSS-REFERENCE TO RELATED APPLICATIONS

This application claims priority to International Patent Application Number PCT/CN2021/130498 filed 15 Nov. 2021, and to Chinese Patent Application Number 202011268005.4, filed 13 Nov. 2020, both of which are hereby incorporated by reference in their entireties.

TECHNICAL FIELD

The present invention relates to the field of hot stamping technologies, and in particular, to a multi-water-channel hot stamping die.

BACKGROUND

After heat treatment such as quenching and nitriding, strength of a high-strength steel plate can reach 1000 to 1500 MPa, which is about 3 to 4 times that of ordinary steel. At room temperature, high-strength steel and ultra-high-strength steel have relatively large yield strength and a small range of plastic deformation. Moreover, when sheet metal has a small thickness, if a common cold stamping manner is adopted, the high-strength steel plate is prone to cracking under a large forming force, and is prone to springback, which reduces dimensional stability of a stamping part. At the same time, there are problems such as die abrasion under the forming force. An existing hot stamping forming technology is generally adopted. The hot stamping forming technology is that a strength steel plate or a high strength steel plate is first heated to 900° C. to 950° C. and held for 2 to 3 min to be completely austenitized, and then a mechanical arm provided with a special clamping mechanism is utilized to quickly and accurately place the heated steel plate into a die for stamping, which is pressurized for a period of time and then quenched in the die to obtain a martensite structure. The martensite structure has high strength, up to 1500 MPa. If the steel plate cannot undergo martensite phase transformation completely, a bainite structure may be generated inside a manufactured part, and mechanical properties of the manufactured part may be greatly affected due to brittleness of the bainite structure. Quality of the design of a cooling part in the die directly affects martensite in an in-die quenching process, and an existing hot stamping die mainly has two problems in practical manufacturing application. One problem is that, when the high-strength steel plate is hot stamped and cooled, it is difficult to control temperatures of the die and the stamping part, resulting in unstable mechanical properties of the stamping part and local differences in the mechanical properties. Another problem is that speeds at which the parts of the stamping part are cooled vary greatly, resulting in a large amount of deformation of the stamping part. Therefore, a multi-water-channel hot stamping die is in urgent need in the industry.

SUMMARY

An objective of the present invention is to provide a multi-water-channel hot stamping die, including an upper die base and a lower die base; the upper die base and the lower die base being each provided with a main water channel, the main water channel including a plurality of die cavities, water through openings being arranged among the die cavities and communicated with each other, a plurality of water diversion channel small holes being arranged in each of the die cavities, an upper die insert being arranged on the upper die base, a lower die insert being arranged on the lower die base, cooling channels being respectively arranged on the upper die insert and the lower die insert and communicated with the water diversion channel small holes, and a cooling medium circulating in the main water channel flowing into the cooling channels of the upper die insert and the lower die insert; the upper die insert and the lower die insert being in direct contact with sheet metal in a stamping process, the sheet metal being hot stamped and formed by using a stamping force of the die, and heat of a formed hot stamping part being transferred to the cooling channels of the upper die insert and the lower die insert by means of heat conduction and heat convection for heat exchange, so that cooling quenching of the stamping part is realized.

Further, the upper die base and the lower die base are each provided with a liquid inlet control valve and a liquid outlet control valve, the liquid inlet control valve and the liquid outlet control valve of the upper die base being respectively connected to two ends of the main water channel of the upper die base, and the liquid inlet control valve and the liquid outlet control valve of the lower die base being respectively connected to two ends of the main water channel of the lower die base.

Further, the main water channel includes a plurality of cooling zones; the cooling zones being formed by the cavities communicated in the main water channel, and specifically including: water retaining blocks arranged in the water through openings at different positions in the die cavities, which block the communication through the water through openings, by which the main water channel is divided into a plurality of separate cooling zones formed by the communicated die cavities.

Further, the upper die insert and the lower die insert are each provided with a plurality of grooves; water diversion blocks are inserted in the grooves of the upper die insert, the water diversion blocks matching the grooves to form a plurality of cooling channels in the upper die insert; and water diversion blocks are inserted in the grooves of the lower die insert, the water diversion blocks matching the grooves to form a plurality of cooling channels in the lower die insert.

Further, the upper die base and the lower die base are provided with cooperating locating members, the locating members each including a locating pin and a locating pin hole, the locating pin being arranged on the lower die base, the locating pin hole being arranged on the upper die base.

Further, the upper die base and the lower die base are provided with cooperating guide members, the guide members each including a guide rod and a guide hole, the guide rod being arranged on the lower die base, the guide hole being arranged on the upper die base.

Further, a stroke cushion block is arranged between the upper die base and the lower die base.

Further, the upper die base and the lower die base are each further provided with a pressure relief valve, the pressure relief valve being communicated with the main water channel, and the pressure relief valve being controlled to exhaust the cooling medium in the main water channels of the upper die base and the lower die base.

Compared with the prior art, the present invention has the following beneficial effects.

The present invention provides a multi-water-channel hot stamping die, including an upper die base, an upper die insert, a lower die base, and a lower die insert. The upper die base and the lower die base are each provided with a main water channel, the main water channel is provided with a plurality of die cavities, water through openings are arranged among the die cavities and communicated with each other, and a caliber of each water through opening is far smaller than a size of each die cavity, which helps to change a cooling medium in the water channels and the die cavities in a stable state into a turbulent flow state, and improve cooling efficiency. At the same time, the plurality of die cavities are arranged in the main water channel in a non-single straight line, water retaining blocks are placed at some water through openings of the die cavities, a plurality of cooling zones can be formed (the plurality of die cavities are divided into a plurality of cooling loops communicated by a single die cavity or a plurality of die cavities), and a plurality of inserts are correspondingly arranged in the plurality of cooling zones, so that the plurality of inserts can be cooled simultaneously and only a certain insert can be supplied with water and cooled, which realizes targeted control over cooling water flow of the main water channel, reduces unnecessary cooling circulation, precisely controls temperatures of various parts in the main water channel, then controls uniform cooling of various parts of the insert, realizes sufficient and uniform cooling of various parts of a hot stamping part, and prevents the problems of unstable mechanical properties and large deformation of the hot stamping part.

In addition to the objectives, features, and advantages described above, other objectives, features, and advantages of the present invention are also provided. The present invention will be described in further detail below with reference to the accompanying drawings.

BRIEF DESCRIPTION OF DRAWINGS

The accompanying drawings, which constitute a part of the present application, are intended to provide further understanding of the present invention, and exemplary embodiments and descriptions of the present invention are intended to explain the present invention, and do not constitute an improper limitation on the present invention. In the drawings.

Figure 1:
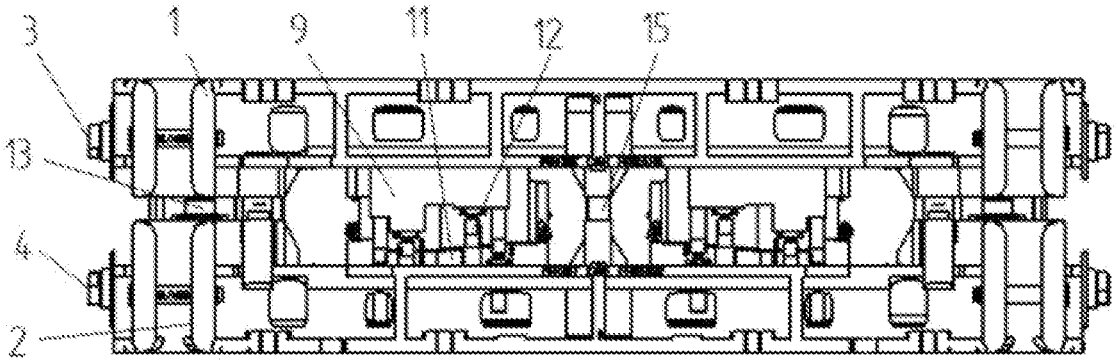
FIG. 1 is a schematic diagram of a multi-water-channel hot stamping die according to a present embodiment.
Figure 2:
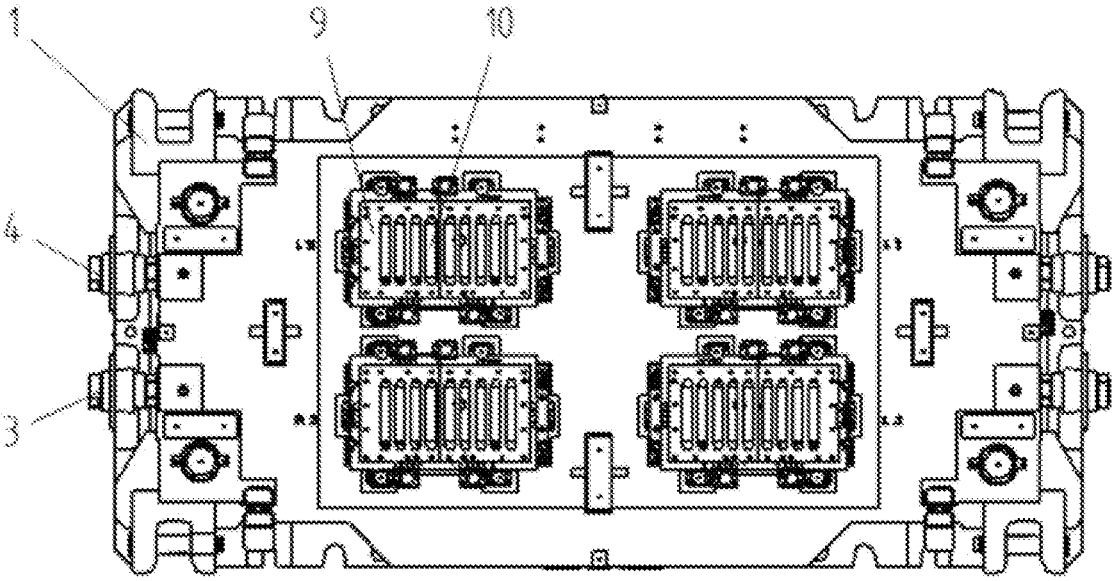
FIG. 2 is a schematic structural diagram of an upper die base of FIG. 1.
Figure 3:
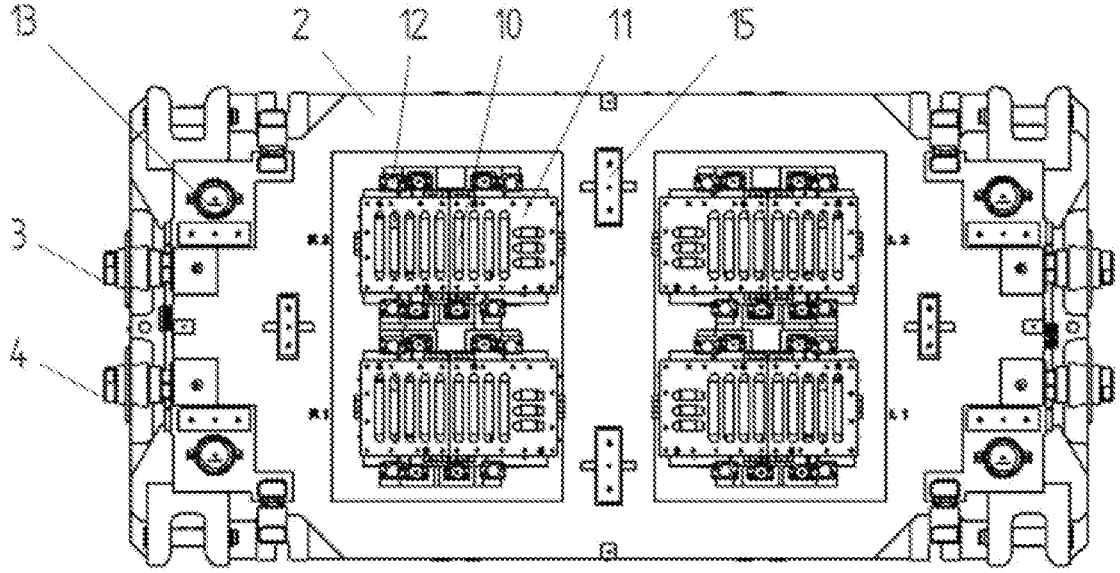
FIG. 3 is a schematic structural diagram of a lower die base of FIG. 1.
Figure 4:
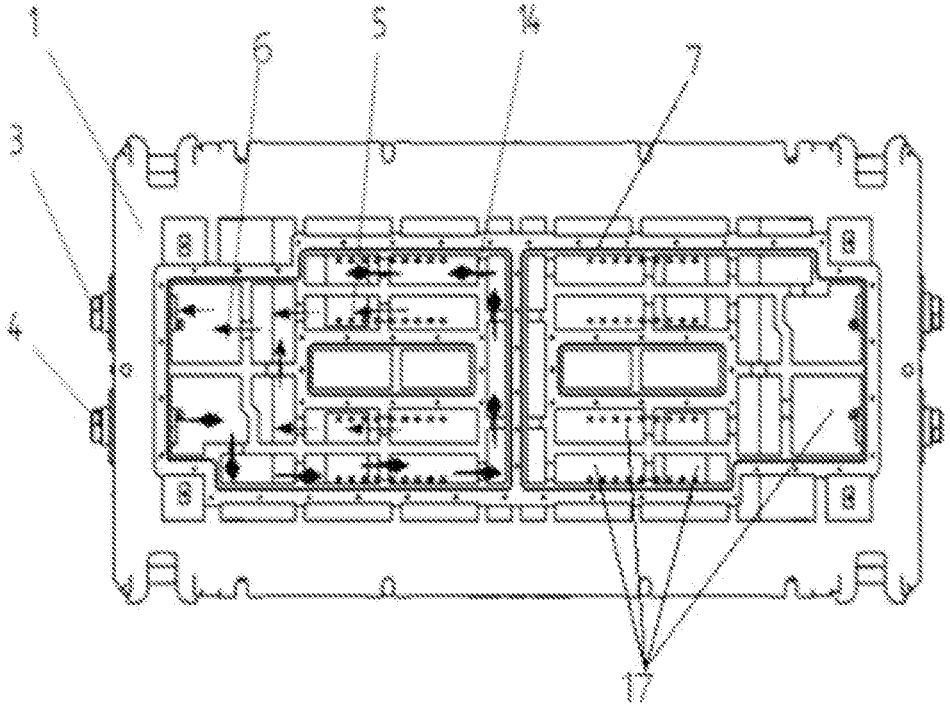
FIG. 4 is a schematic structural diagram of arrangement of a water channel in the upper die base.
Figure 5:
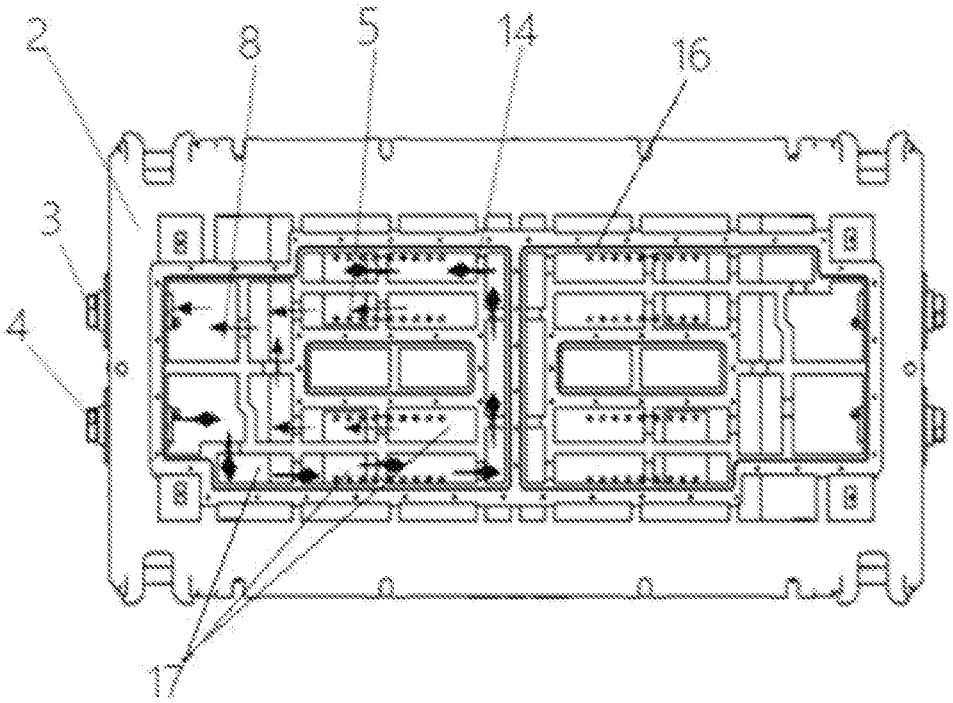
FIG. 5 is a schematic structural diagram of arrangement of a water channel in the lower die base.

1. upper die base, 2. lower die base, 3. liquid outlet control valve, 4. liquid inlet control valve, 5. water diversion channel small hole, 6. first main water channel, 7. second main water channel, 8. third main water channel, 9. upper die insert, 10. water diversion block, 11. lower die insert, 12. locating member, 13. guide member, 14. water through opening, 15. stroke cushion block, 16 fourth main water channel, 17. die cavity.

DESCRIPTION OF EMBODIMENTS

Embodiments of the present invention are described in detail below with reference to the accompanying drawings, but the present invention may be implemented in many different manners as defined and covered by the claims.

Referring to FIG. 1 to FIG. 5, a multi-water-channel hot stamping die includes an upper die base 1, an upper die insert 9, a lower die base 2, and a lower die insert 11. The upper die base and the lower die base are each provided with a main water channel, the main water channel is provided with a plurality of die cavities 17, the plurality of die cavities are arranged in the main water channel in a non-single straight line, water through openings 14 are arranged among the die cavities and communicated with each other, and a plurality of water diversion channel small holes 5 are arranged in each of the die cavities. The upper die insert is arranged on the upper die base, the upper die insert is provided with a cooling channel, and the cooling channel of the upper die insert is communicate with the water diversion channel small holes of the main water channel in the upper die insert. The lower die insert is arranged on the lower die base, and a cooling channel of the lower die insert is communicate with the water diversion channel small holes of the main water channel in the lower die insert. The upper die base and the lower die base are each provided with a liquid inlet control valve 4 and a liquid outlet control valve 3, the liquid inlet control valve and the liquid outlet control valve of the upper die base are respectively connected to two ends of the main water channel of the upper die base, and the liquid inlet control valve and the liquid outlet control valve of the lower die base are respectively connected to two ends of the main water channel of the lower die base. In the present embodiment, the water diversion channel small holes are circular holes.

A cooling medium flows into the die cavities arranged in the main water channel through the liquid inlet control valve, and the cooling medium in the cavities flows into the cooling channels of the upper die insert and the lower die insert through the water diversion channel small holes. The upper die insert and the lower die insert are in direct contact with sheet metal in a stamping process, the sheet metal is hot stamped and formed by using a stamping force of the die, and heat of a formed hot stamping part is transferred to the cooling channels of the upper die insert and the lower die insert by means of heat conduction and heat convection for heat exchange with the cooling medium, so that cooling quenching of the stamping part is realized. In the present embodiment, the cooling medium is water.

Figure 6:
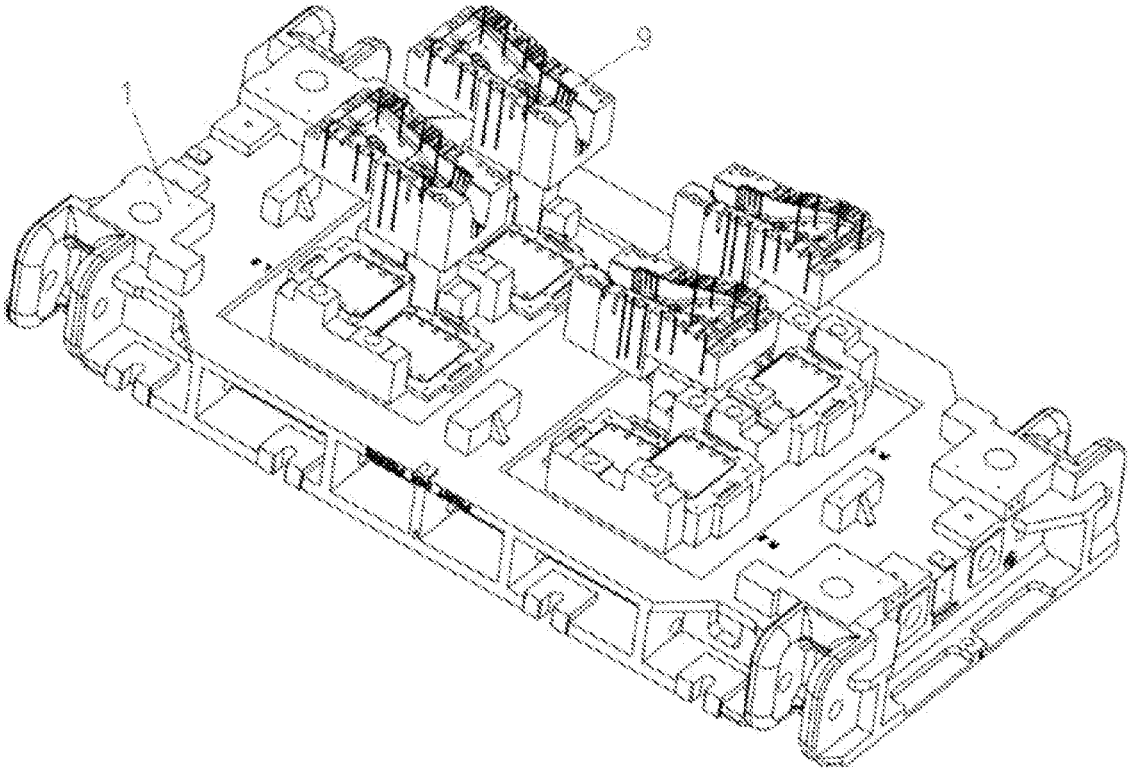
FIG. 6 is a schematic structural diagram of the upper die base and an upper die insert.
Figure 7:
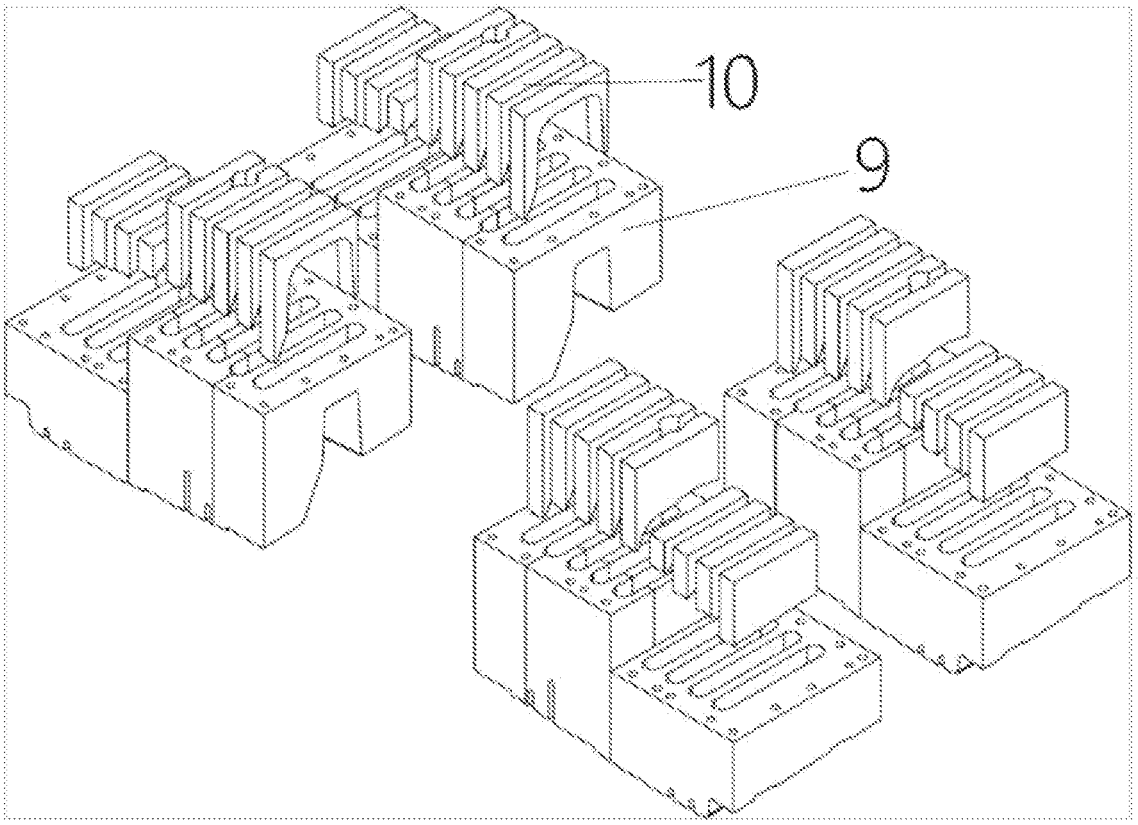
FIG. 7 is a schematic structural diagram of the upper die insert and a water diversion block.

Referring to FIG. 6 and FIG. 7, the cooling channel is specifically formed by a groove and a water diversion block 10 that are machined on an insert. A plurality of grooves are machined on the upper die insert, water diversion blocks 10 are inserted in the grooves of the upper die insert 9, the water diversion blocks match the grooves to form a plurality of cooling channels in the upper die insert, and the plurality of cooling channels surround the upper die insert. A plurality of grooves are machined on the lower die insert, water diversion blocks are inserted in the grooves of the lower die insert, the water diversion blocks match the grooves to form a plurality of cooling channels in the lower die insert, and the plurality of cooling channels surround the lower die insert. The upper die insert and the lower die insert are provided with a plurality of cooling channels, so that the cooling medium can flow through the upper die insert and the lower die insert quickly, the temperature of each part of the insert can be accurately controlled while the insert is cooled quickly, rapid cooling and quenching of the sheet metal in the die can be realized, and a mechanical property requirement of hot stamping of a high-strength steel plate can be met.

A first main water channel 6 and a second main water channel 7 which are independent are arranged on the upper die base, the first main water channel and the second main water channel have exactly the same structure, and a plurality of cooling zones are arranged on the first main channel. The cooling zones are formed by the cavities communicated in the first main water channel, and specifically include: water retaining blocks arranged in the water through openings at different positions in the die cavities, which block the communication through the water through openings, by which the main water channel is divided into a plurality of separate cooling zones formed by the communicated die cavities (i.e., the water through openings of the cavities of some of the main water channels are blocked by the water retaining blocks to form a cooling loop which is communicated with a single die cavity or a plurality of die cavities in the required cooling zone).

In the present embodiment, two upper die inserts are arranged on the first main water channel, specifically including a first upper die insert and a second upper die insert. The first upper die insert and the second upper die insert are arranged in parallel in the cooling zones of the first main water channel. The first upper die insert and the second upper insert share the liquid inlet control valve and the liquid outlet control valve of the first main water channel and a same main water channel cooling cycle. At the same time, the water retaining blocks are placed in the water through openings of the cavities of the first main water channel to control distribution of water channel flow of the two inserts arranged in parallel, so that the two inserts can be cooled simultaneously and only a certain insert can be supplied with water and cooled, which realizes targeted control over cooling water flow in the cooling zones of the first main water channel, reduces unnecessary cooling circulation, precisely controls temperatures of various parts in the cooling zones, improves quenching and cooling effects of the stamping part, and prevents the problems of unstable mechanical properties and large deformation of the hot stamping part.

Water through openings are arranged among the plurality of die cavities of the main water channel and communicated with each other, and a caliber of each water through opening is far smaller than a size of each die cavity, which helps to change a cooling medium in the water channels and the die cavities in a stable state into a turbulent flow state, and improve cooling efficiency. When flowing in the main water channel and the die cavity, the cooling medium is in a relatively stable flow state, and generally flows quickly at the center and flows slowly near a wall surface of the water channel. When flowing through the water through opening, the cooling water passes through a zone where a cross-sectional area suddenly decreases, the flow state inside the cooling water changes, which is no longer a steady state with a high flow velocity in the middle and a slow flow velocity around and changes into a turbulent flow state, thereby accelerating heat exchange between the cooling water and the insert, and better realizing sufficient cooling of the insert and the stamping part. At the same time, a plurality of cooling channels are distributed around the insert, which realizes uniform cooling of various parts of the insert, is conducive to uniform cooling of the hot stamping part, facilitates shaping of the hot stamping part, and control deformation and rebound of the hot stamping part.

A third main water channel 8 and a fourth main water channel 16 which are independent are arranged on the lower die base 2. The third main water channel and the fourth main water channel have exactly the same structure, a structural design of the third main water channel in the lower die base is basically the same as that of the second main water channel in the upper die base, and a difference of the two only lies in that the upper die insert arranged on the upper die base is changed into the lower die insert 11.

The upper die base 1 and the lower die base 2 are provided with cooperating locating members 12, and the locating members each include a locating pin and a locating pin hole. Preferably, the locating pin is arranged on the lower die base, and the locating pin is located on a peripheral side of the lower die insert. The locating pin hole is arranged on the upper die base, and the locating pin hole is located on a peripheral side of the corresponding upper die insert. The locating member is configured to position and match the upper die insert and the lower die insert, and improve accuracy of die stamping. The upper die base 1 and the lower die base 2 are provided with cooperating guide members 13, and the guide members each include a guide rod and a guide hole. Preferably, the guide rod is arranged on the lower die base, and the guide hole is arranged on the upper die base. The guide member helps to improve stable operation of the upper die base and the lower die base during stamping. At the same time, in cooperation with a synergistic effect of the locating member, a forming error of the stamping part generated during hot stamping forming of the die is effectively reduced. In addition, a stroke cushion block 15 is arranged between the upper die base 1 and the lower die base 2, the stroke cushion block is preferably made of rubber, and the stroke cushion block provides a cushioning effect and is used for preventing damages to the die during hot stamping of the upper die base and the lower die base.

Water channel cover plates are arranged on the main water channels of the upper die base and the lower die base, the water channel cover plates of the upper die base and the lower die base are each provided with a pressure relief valve, the pressure relief valve is communicated with the main water channel to protect the circulation safety of the main water channel, and meanwhile, the pressure relief valve of the main water channel is controlled to exhaust the cooling medium in the main water channels of the upper die base and the lower die base.

The above descriptions are only preferred embodiments of the present invention and are not intended to limit the present invention. For those skilled in the art, the present invention may have various modifications and changes. Any modification, equivalent replacement, improvement, or the like made within the spirit and principle of the present invention should fall within the protection scope of the present invention.

The invention claimed is:

1. A multi-water-channel hot stamping die, comprising an upper die base and a lower die base;

wherein the upper die base includes a first independently controlled main water channel on a first side thereof and a second independently controlled main water channel on a second side thereof, the first and second main water channels having symmetrical configurations relative to each other;

the lower die base includes third independently controlled main water channel on a first side thereof and a fourth independently controlled main water channel on a second side thereof, the third and fourth main water channels having symmetrical configurations relative to each other;

each main water channel comprises a plurality of die cavities, water through openings arranged among the plurality of die cavities in communication with one another, and a water diversion channel aperture is arranged in at least one of the plurality of die cavities; and an upper die insert is arranged on the upper die base, and a lower die insert is arranged on the lower die base, the upper die insert and the lower die insert each including cooling channels in communication with the water diversion channel apertures.

2. The multi-water-channel hot stamping die of claim 1, wherein a cooling medium circulates in each main water channel flowing into the cooling channels of the upper die insert and the lower die insert.

3. The multi-water-channel hot stamping die of claim 1, wherein the upper die base and the lower die base are provided with a liquid inlet control valve and a liquid outlet control valve for each main water channel, the liquid inlet control valves and the liquid outlet control valves of the upper die base being respectively connected to two ends of the first and second main water channels, and the liquid inlet control valve and the liquid outlet control valve of the lower die base being respectively connected to two ends of the third and fourth main water channels.

4. The multi-water-channel hot stamping die according to claim 3, comprising a plurality of cooling zones formed by the die cavities in the main water channels, and including water retaining blocks arranged in the water through openings at different positions in the die cavities.

5. The multi-water-channel hot stamping die according to claim 3, wherein the upper die insert and the lower die insert are each provided with a plurality of grooves;

wherein water diversion blocks are inserted in each groove of the upper die insert, the water diversion blocks being in registration with the grooves to form a plurality of cooling channels in the upper die insert; and water diversion blocks are inserted in each groove of the lower die insert, the water diversion blocks matching the grooves to form a plurality of cooling channels in the lower die insert.

6. The multi-water-channel hot stamping die of claim 1, wherein the upper die base and the lower die base are provided with cooperating locating members, the locating members each comprise a locating pin and a locating pin hole, the locating pin is arranged on the lower die base, and the locating pin hole is arranged on the upper die base.

7. The multi-water-channel hot stamping die of claim 3, wherein the upper die base and the lower die base are provided with cooperating locating members, the locating members each comprise a locating pin and a locating pin hole, the locating pin is arranged on the lower die base, and the locating pin hole is arranged on the upper die base.

8. The multi-water-channel hot stamping die of claim 4, wherein the upper die base and the lower die base are provided with cooperating locating members, the locating members each comprise a locating pin and a locating pin hole, the locating pin is arranged on the lower die base, and the locating pin hole is arranged on the upper die base.

9. The multi-water-channel hot stamping die of claim 5, wherein the upper die base and the lower die base are provided with cooperating locating members, the locating members each comprise a locating pin and a locating pin hole, the locating pin is arranged on the lower die base, and the locating pin hole is arranged on the upper die base.

10. The multi-water-channel hot stamping die of claim 6, wherein the upper die base and the lower die base are provided with cooperating guide members, the guide members each comprising a guide rod and a guide hole, the guide rod being arranged on the lower die base, the guide hole being arranged on the upper die base.

11. The multi-water-channel hot stamping die of claim 7, wherein the upper die base and the lower die base are provided with cooperating guide members, the guide members each comprising a guide rod and a guide hole, the guide rod being arranged on the lower die base, the guide hole being arranged on the upper die base.

12. The multi-water-channel hot stamping die of claim 8, wherein the upper die base and the lower die base are provided with cooperating guide members, the guide members each comprising a guide rod and a guide hole, the guide rod being arranged on the lower die base, the guide hole being arranged on the upper die base.

13. The multi-water-channel hot stamping die of claim 9, wherein the upper die base and the lower die base are provided with cooperating guide members, the guide members each comprising a guide rod and a guide hole, the guide rod being arranged on the lower die base, the guide hole being arranged on the upper die base.

14. The multi-water-channel hot stamping die according to claim 10, wherein a stroke cushion block is arranged between the upper die base and the lower die base.

15. The multi-water-channel hot stamping die according to claim 11, wherein a stroke cushion block is arranged between the upper die base and the lower die base.

16. The multi-water-channel hot stamping die according to claim 12, wherein a stroke cushion block is arranged between the upper die base and the lower die base.

17. The multi-water-channel hot stamping die according to claim 13, wherein a stroke cushion block is arranged between the upper die base and the lower die base.

18. The multi-water-channel hot stamping die according to claim 14, wherein the upper die base and the lower die base are each further provided with a pressure relief valve, the pressure relief valve being communicated with the main water channel, and the pressure relief valve being controlled to exhaust the cooling medium in the main water channels of the upper die base and the lower die base.

19. The multi-water-channel hot stamping die according to claim 15, wherein the upper die base and the lower die base are each further provided with a pressure relief valve, the pressure relief valve being communicated with the main water channel, and the pressure relief valve being controlled to exhaust the cooling medium in the main water channels of the upper die base and the lower die base.

20. A method of cooling quenching a stamped part comprising:

providing the multi-water-channel hot stamping die of claim 1, providing a cooling medium within the cooling channels of the upper die insert and lower die insert of said multi-water-channel hot stamping die, providing a hot stamped sheet metal, and contacting the upper die insert and lower die insert of said multi-water-channel hot stamping die with said hot stamped sheet metal, wherein heat of the stamped sheet metal is transferred to the cooling channels of the upper die insert and the lower die insert.

* * * * *